US005322097A

United States Patent [19]

Wright

[11] Patent Number: 5,322,097

[45] Date of Patent: Jun. 21, 1994

[54] AUTOMATIC FUNNEL

[76] Inventor: Terry M. Wright, 1205 Coolbaugh, Red Oak, Iowa 51566

[21] Appl. No.: 75,607

[22] Filed: Jun. 14, 1993

[51] Int. Cl.[5] ..... B67C 11/06

[52] U.S. Cl. ..... 141/199; 141/96; 141/216; 141/331; 141/345; 340/623; 116/110; 73/308; 73/294

[58] Field of Search ..... 141/94-96, 141/198-205, 212, 216, 331, 339-342, 344-345, 42, 43; 73/294, 308, 305, 306, 307, 309, 314, 322.5; 340/618, 623-625; 116/110, 228

[56] References Cited

U.S. PATENT DOCUMENTS

| | | | |
|---|---|---|---|
| 159,445 | 2/1875 | Pforr | 141/345 |
| 211,352 | 1/1879 | Smith | 141/345 |
| 1,031,567 | 7/1912 | Miller | 141/200 |
| 1,069,579 | 8/1913 | Robblee | 141/200 |
| 1,107,774 | 8/1914 | Frederick | 141/204 |
| 1,188,477 | 6/1916 | Ostrander | 141/201 |
| 1,287,528 | 12/1918 | Vettermann | 141/199 |
| 1,316,167 | 9/1919 | Lecrone | 141/95 |
| 1,333,756 | 3/1920 | Heimgartner | 141/95 |
| 1,425,100 | 8/1922 | Jones et al. | 141/201 |
| 5,004,024 | 4/1991 | Rezmer et al. | 141/298 |

FOREIGN PATENT DOCUMENTS

| | | | |
|---|---|---|---|
| 0628029 | 10/1927 | France | 141/204 |

*Primary Examiner*—J. Casimer Jacyna
*Attorney, Agent, or Firm*—E. Michael Combs

[57] ABSTRACT

A funnel body includes an exit tube, wherein a mesh web pocket is arranged for securement to a lowermost end of the exit tube secured to an annular groove, with the pocket including a buoyant sphere arranged for projection into the exit tube exit opening for curtailing fluid flow therethrough.

2 Claims, 4 Drawing Sheets

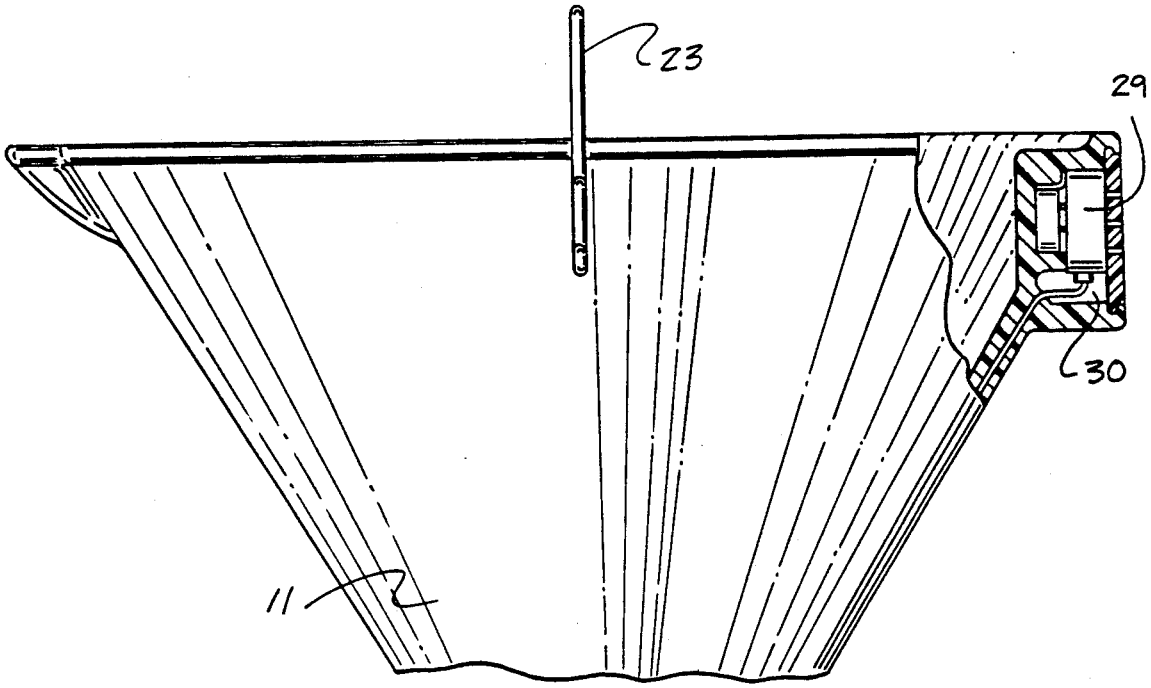
FIG. 7
FIG. 8
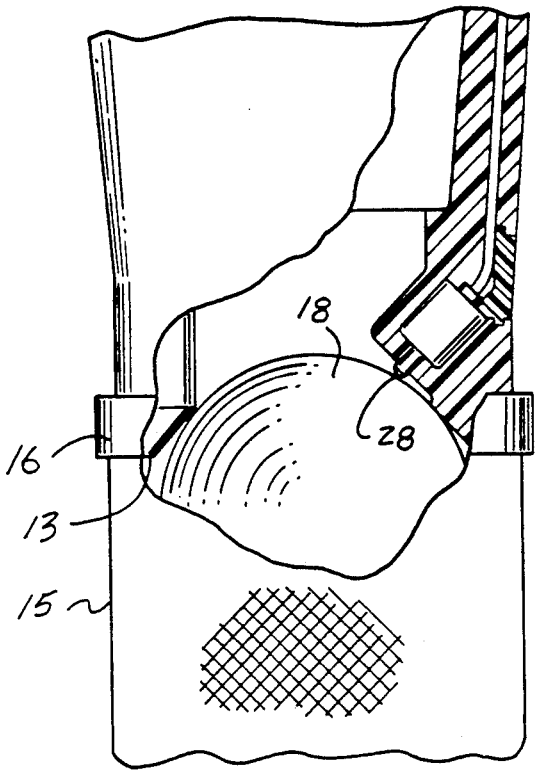

AUTOMATIC FUNNEL

BACKGROUND OF THE INVENTION

1. Field of the Invention

The field of invention relates to funnel structure, and more particularly pertains to a new and improved automatic funnel including a buoyant ball operative to a check valve to provide visual indication of fluid within a container directed to the buoyant sphere to effect fluid collection in the sphere indicating ample fluid within the container structure to be filled.

2. Description of the Prior Art

Funnels of various types are utilized throughout the prior art and exemplified by the U.S. Pat. Nos. 4,901,776; 5,004,024; and 4,986,437.

The instant invention attempts to overcome deficiencies of the prior art by providing for a check ball structure arranged for projection into the lowermost end of the outlet tube of the funnel to indicate sufficient fluid within a container to be filled.

SUMMARY OF THE INVENTION

In view of the foregoing disadvantages inherent in the known types of funnel structure now present in the prior art, the present invention provides an automatic funnel indicating sufficient fluid within a container to be filled by directing a check ball into the exit end of the outlet conduit of the funnel. As such, the general purpose of the present invention, which will be described subsequently in greater detail, is to provide a new and improved automatic funnel which has all the advantages of the prior art funnel structure and none of the disadvantages.

To attain this, the present invention provides a funnel body including an exit tube, wherein a mesh web pocket is arranged for securement to a lowermost end of the exit tube secured to an annular groove, with the pocket including a buoyant sphere arranged for projection into the exit tube exit opening for curtailing fluid flow therethrough.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved automatic funnel which has all the advantages of the prior art funnel structure and none of the disadvantages.

It is another object of the present invention to provide a new and improved automatic funnel which may be easily and efficiently manufactured and marketed.

It is a further object of the present invention to provide a new and improved automatic funnel which is of a durable and reliable construction.

An even further object of the present invention is to provide a new and improved automatic funnel which is susceptible of a low cost of manufacture with regard to both materials and labor, and which accordingly is then susceptible of low prices of sale to the consuming public, thereby making such automatic funnels economically available to the buying public.

Still yet another object of the present invention is to provide a new and improved automatic funnel which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 7 is an orthographic partial view, partially in cross-section indicating the audible signal structure.

FIG. 8 is an orthographic view, partially in cross-section indicating the buoyant sphere arranged for cooperation with the center leg in communication with the audible alarm of FIG. 7.

DESCRIPTION OF THE PREFERRED EMBODIMENT

Figure 1:
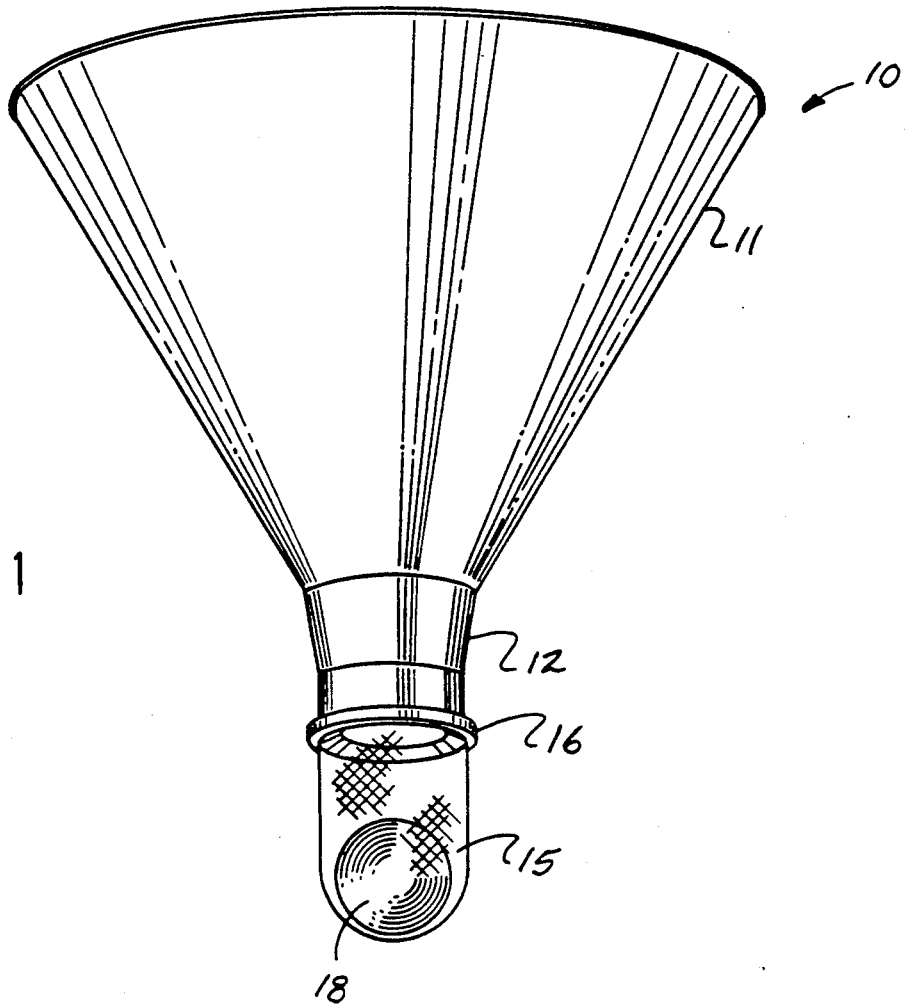
FIG. 1 is an isometric illustration of the invention.

With reference now to the drawings, and in particular to FIGS. 1 to 8 thereof, a new and improved automatic funnel embodying the principles and concepts of the present invention and generally designated by the reference numeral 10 will be described.

Figure 2A:
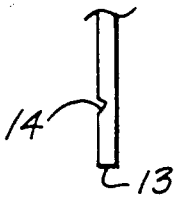
FIG. 2*a* is an orthographic view indicating the annular groove adjacent the exit end of the outlet conduit.
Figure 2:
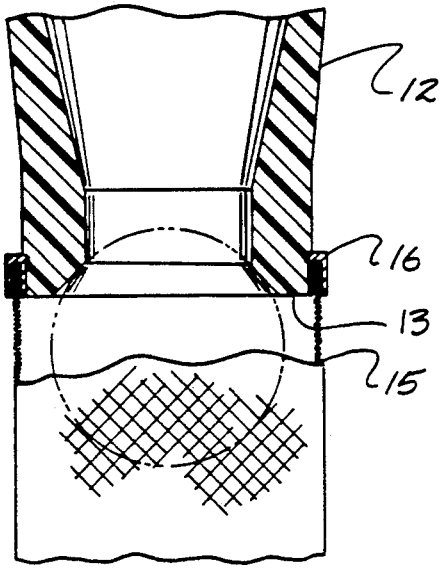
FIG. 2 is an orthographic cross-sectional illustration of the lowermost end of the funnel having the mesh pocket secured thereto in cooperation with the check ball.
Figure 3:
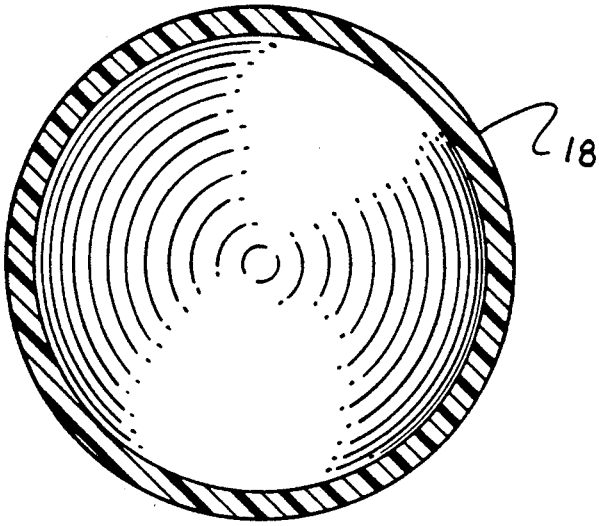
FIG. 3 is an orthographic cross-sectional illustration of the buoyant sphere.
Figure 4:
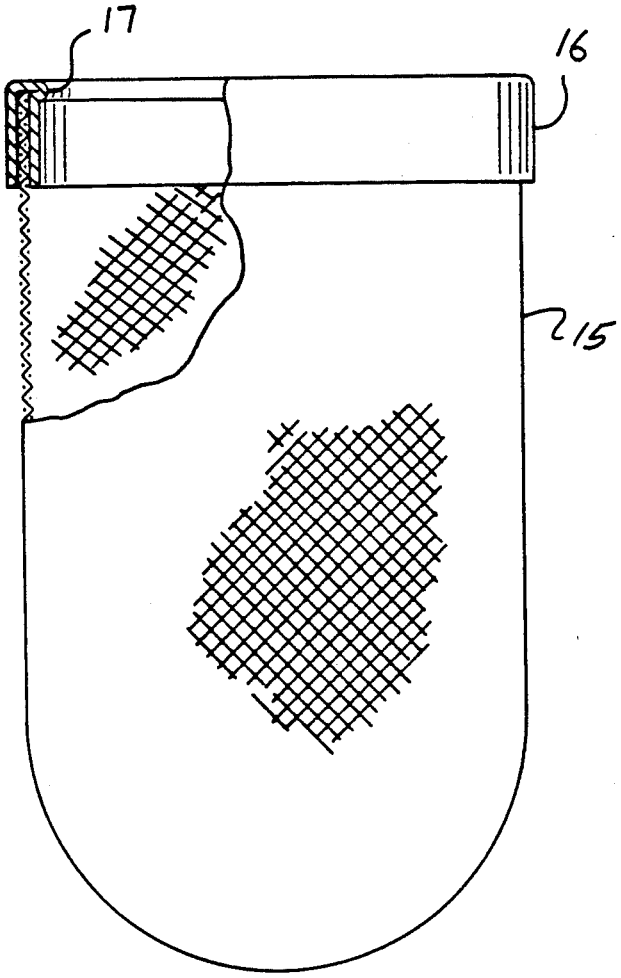
FIG. 4 is an orthographic view, partially in cross-section of the mesh web pocket.

More specifically, the automatic funnel 10 of the instant invention essentially comprises a conical frontal body 11, having an exit tube 12 extending therefrom in fluid communication with the funnel body, wherein the exit tube 12 is of a predetermined tube diameter and has an exit tube lowermost end 13 in surrounding relationship about an exit tube exit end. An annular groove 14 (see FIG. 2*a*) is directed into the exit tube 12 in adjacency to the lowermost end 13. A mesh web pocket 15 is provided, including a pocket annular entrance ring 16, having a ring annular projection 17 arranged for reception within the annular groove 14 of resilient construction for securement of the mesh web pocket 15 to the exit tube 12 extending and projecting therebeyond and therebelow, with a buoyant sphere 18 mounted within the mesh web pocket whereupon filling of a container, the buoyant sphere extends into the exit tube exit end opening to effect blockage thereof and provide for fluid filling within the exit tube and frontal body for visual indication of ample fluid within a container (not shown) to filled.

Figure 5:
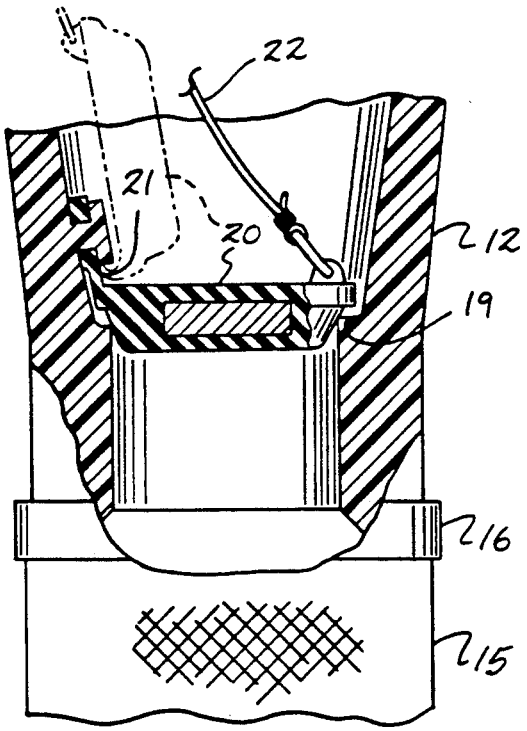
FIG. 5 is an isometric illustration of the invention further employing a closure door.
Figure 6:
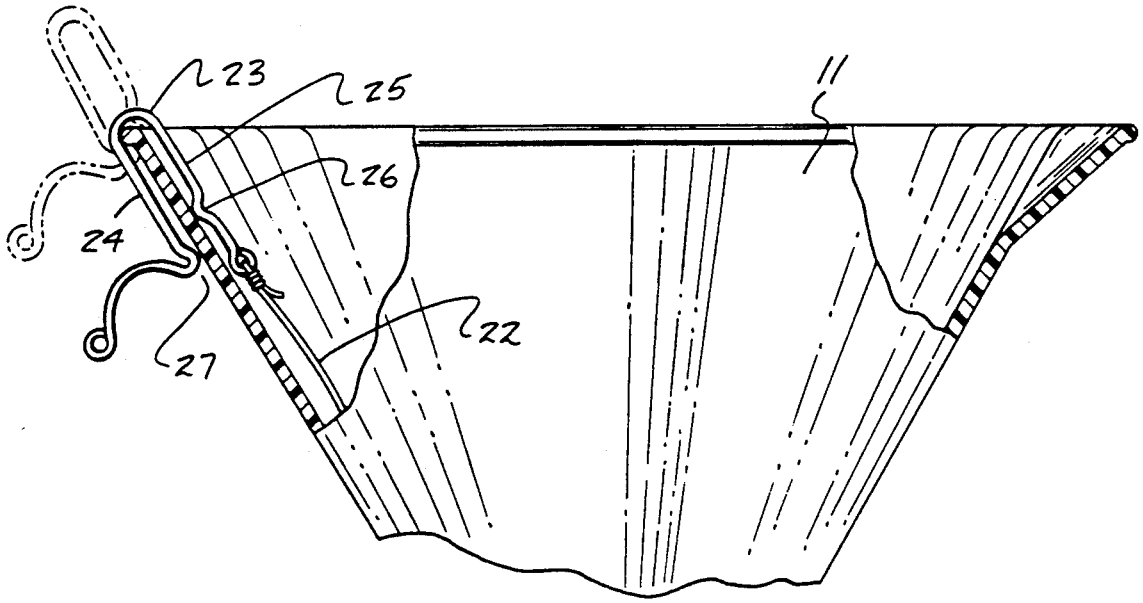
FIG. 6 is an orthographic partial view, partially in cross-section of the mounting clip structure relative to the closure door.

The FIG. 5 indicates the use of an exit tube annular seat 19 positioned within the exit tube 12, with a door 20 provided, having a door hinge 21 arranged for directing the door 20 over the annular seal 19 in fluid impermeable communication therewith, wherein a tether line 22 having its first end secured to the door 20 spaced from the hinge 21 includes a second end secured to a U-shaped spring clip 23 arranged for mounting to the entrance periphery of the funnel tube 11, as indicated in FIG. 6. The U-shaped spring clip 23 includes clip first and second legs 24 and 25 respectively, with the second clip 25 including a leg projecting 26 in facing relationship medially of the first leg 24 to effect spacing of the door 20 from the seat 19, with projection of the clip fully onto the seat, as indicated in FIG. 6, permitting closure of the door, in a manner as indicated in FIG. 5. A U-shaped clip entrance end 27 provides ease of directing the clip structure onto the periphery of the funnel body 11.

The FIGS. 7 and 8 includes a central leg 28 mounted within the exit tube in facing relationship relative to the lowermost end 13 for abutment with the buoyant sphere 18 when the buoyant sphere is in contiguous communication with the exit tube outlet opening, such that the central leg 28 is in electrical communication with an audible alarm 29 having a self-included battery 29 to effect actuation of the audible alarm 29 upon the central leg 20 engaging the buoyant sphere. A body cavity 30 mounted to the funnel body 11 at the annular entrance periphery provides spaced orientation of the audible alarm to provide for such maximum spacing preventing fluid communication with the body cavity 30 during a filling procedure. It should be understood that a simple DC circuit may be employed, whereupon the central leg 28 is operative with a switch to effect electrical communication of the audible alarm 29 relative to its included battery.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An automatic funnel having a funnel body, including an entrance periphery and an exit tube mounted to the funnel body spaced from the entrance periphery, the exit tube in fluid communication with the funnel body, and the exit tube having a lowermost end in surrounding relationship relative to an outlet opening, and an annular groove directed into the exit tube adjacent the lowermost end, and a mesh web pocket, having a pocket annular entrance ring, having a ring projection arranged for reception within an annular groove, with the pocket including a buoyant sphere, with the buoyant sphere spaced from the outlet opening in a first position and arranged for communication with the outlet opening second position, and the exit tube includes an annular seat within the exit tube between the funnel body and the lowermost end, with the funnel body including a door hingedly mounted within the exit tube, the door having a tether line, the tether line including a first end secured to the door, and the tether line having a second end, a U-shaped spring clip, with the U-shaped spring clip secured to said second end, the U-shaped spring clip including a first leg spaced from a second leg and a connecting web, with the second leg including a second leg projection arranged in facing relationship relative to the first leg medially of the second leg, with the U-shaped clip including an entrance end, with the clip arranged for securement to the entrance periphery of the funnel body in the first position between the projection and the entrance end, and projection upon the entrance periphery in abutment with the connecting web of the U-shaped clip.

2. A funnel as set forth in claim 1 including a central leg mounted within the funnel body in facing orientation relative to the lowermost end for abutment of the buoyant sphere when the buoyant sphere is in a second position, and an audible alarm mounted to the funnel body within a body cavity, with the body cavity in adjacency to the funnel body spaced from the exit tube, with the audible alarm arranged in electrical communication with the central leg to effect actuation of the audible alarm upon the central leg engaging the buoyant sphere.

* * * * *